United States Patent [19]

Vainer

[11] 4,074,962

[45] Feb. 21, 1978

[54] ELECTRODE CONSTRUCTION FOR A PIEZOELECTRIC LIGHTER

[75] Inventor: Ernesto A. Vainer, Buenos Aires, Argentina

[73] Assignee: Manufactura de Articulos para el Hogar "Aurora" S.A. Industrial, Comercial, Inmobiliaria y Financiera, Argentina

[21] Appl. No.: 628,527

[22] Filed: Nov. 3, 1975

[51] Int. Cl.[2] ..... F23Q 2/28; F23Q 3/01

[52] U.S. Cl. ..... 431/255; 431/132; 431/264; 361/253

[58] Field of Search ..... 431/255, 132, 264; 317/96; 312/325

[56] References Cited

U.S. PATENT DOCUMENTS

| | | | |
|---|---|---|---|
| 2,430,929 | 11/1947 | Hankins | 313/325 |
| 3,295,024 | 12/1966 | Newman | 431/255 |
| 3,393,038 | 7/1968 | Burkholter | 431/66 |
| 3,521,987 | 7/1970 | Goto | 431/255 |
| 3,562,590 | 2/1971 | Mitts et al. | 317/98 |
| 3,741,714 | 6/1973 | Yoshinaga | 431/255 |
| 3,759,658 | 9/1973 | Mifune | 431/255 |
| 3,843,311 | 10/1974 | Nelson | 431/264 |

*Primary Examiner*—Paul E. Maslousky

*Attorney, Agent, or Firm*—Allegretti, Newitt, Witcoff & McAndrews

[57] ABSTRACT

The present invention refers to an improved construction for electrodes used with a piezoelectric lighter, particularly one of the portable type which may be used by a smoker and which carries a fuel deposit.

2 Claims, 3 Drawing Figures

ELECTRODE CONSTRUCTION FOR A PIEZOELECTRIC LIGHTER

BACKGROUND OF THE INVENTION

The piezoelectric ignition mechanisms used in present lighters fed with gaseous or gasified fuel are well known, as well as those ignition means that, aside from the devices, constitute real spark arresters. These devices have an operation mechanism over the piezoelectric ignition unit, which, when actuated, originate a potential difference capable of causing a spark between the electrodes arranged at a predetermined distance. These electrodes are metal conductors that are in contact with the positive and negative poles of the ignition unit. In such types of ignition devices for household appliances, generally the spark that is produced is referred to as a cold or white, short spark capable of igniting a gas accumulation in its vicinity.

In the case of lighters that carry their own fuel source, such as those used by smokers, the gaseous or gasified fuel comes out through a spout arranged in proximity to the space in which the spark is produced. The spout causes the formation of a small fluid channel and the sparks of the above mentioned type originate a thrust of the outlet gas current without igniting the same.

In order to overcome this difficulty, fuel carrying lighters have included a resistor connected in series with the positive pole conductor. This resistor, having an impedance of many thousand ohms, causes the spark produced between the bare conductors forming the electrodes to be a reddish color, called a hot spark, which is capable of igniting the gas current that emerges from the spout of the lighter.

Besides requiring a resistance, which in ordinary cases is of about 30,000 to 50,000 ohms, the prior lighter also causes degrading of the bare metal conductors which constitutes the electrodes, due to heat and oxidation.

SUMMARY OF THE PRESENT INVENTION

This invention is directed toward a portable piezoelectric-type lighter having a pressurized fluid fuel deposit therein, an exit orifice for permitting the release of the fluid fuel and a pair of electrodes separated by a predetermined gap. The electrodes are connected to a piezoelectric ignition unit for developing an electric potential between the electrodes when the ignition unit is actuated. A semiconductor forms one of the electrodes and is connected to a conductor, which is connected to the positive pole of the ignition unit. A fastening means is provided to cover and insulate the connected portions of the semiconductor electrode and the conductor.

In a second preferred embodiment the second electrode is also a semiconductor and a separate fastening means is provided for it.

Accordingly, one object of the present invention is to provide an improved piezoelectric lighter of efficient and longlasting construction.

Another object of the present invention is to eliminate the need for a resistor connected in series with the bare metal conductor which constitutes the positive electrode.

Another object of the present invention is to eliminate the metal electrode that forms the bare terminal of the positive conductor, thereby avoiding degradation of same by oxidation and lengthening its useful life without replacement.

Another object of the present invention is to provide a simplified more efficient construction for a lighter in which the electrode functions as an electrode and also provides the necessary resistance to obtain a spark gap capable of igniting the gas current of a portable lighter for smokers.

The invention is adapted for use with a portable lighter and includes an electrode, in at least one terminal that determines the spark gap, of semiconductor material that simultaneously fulfills the function as a discharge terminal and has its own resistance capable of producing the adequate spark gap for the aforesaid ignition.

The semiconductor can be used on only one of the electrodes connected to the ignition unit or on both electrodes of the assembly.

The semiconductor can also be used by determining the spark gap with the gas outlet spout or burner, or between same and an electrode connected to the gas flow.

The configuration of the semiconductor electrode may be any adequate one, and the electrode can also define the spark gap in the flame area, above the gas outlet spout.

These and other advantages and features of the present invention are more fully set forth in the following detailed description of the invention.

BRIEF DESCRIPTION OF THE DRAWINGS

There follows a brief description of the drawings showing presently preferred embodiments of the present invention wherein like numerals refer to like elements and wherein.

DETAILED DESCRIPTION OF THE PREFERRED EMBODIMENTS d

Figure 1:
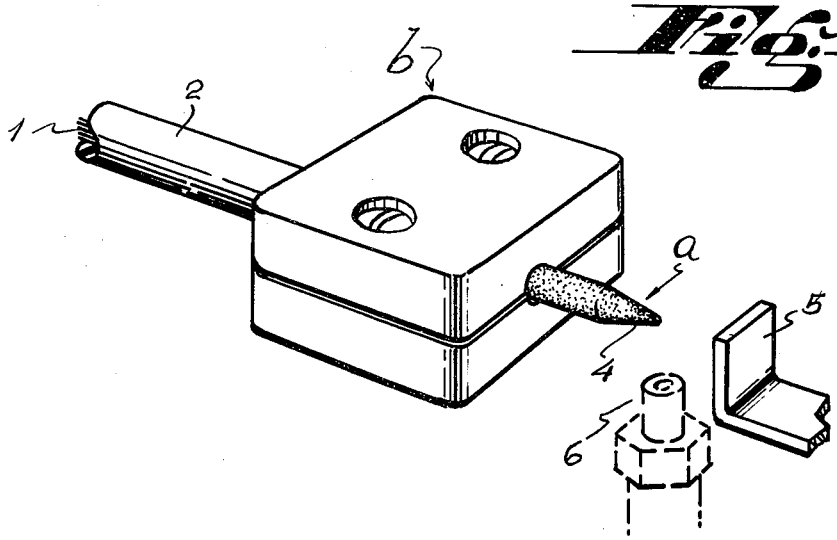
FIG. 1 is an enlarged perspective view of the present invention showing a gas discharge spout of the lighter, the semiconductor connected in series to the positive pole of the ignition unit, and an ordinary type metal electrode connected to the negative pole of the ignition unit.
Figure 2:
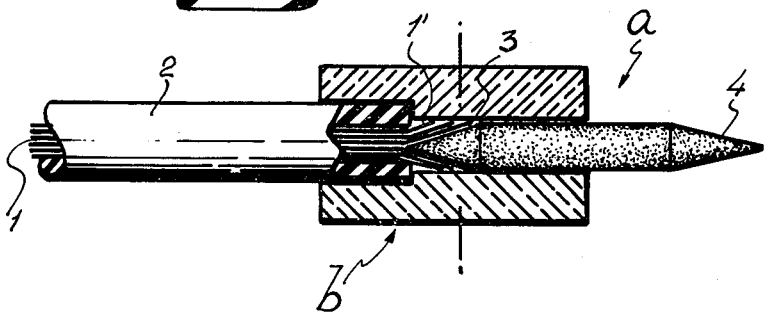
FIG. 2 is an enlarged side cross sectional view of the semiconductor of FIG. 1.

Referring to FIGS. 1 and 2, the conductor 1 coming from a positive pole of an ignition unit (not shown) is covered by an insulating sheath or jacket 2, the end of which is opened to filaments 1', that form the conductor 1. An end 3 of a semiconductor *a* having an elongated form is inserted between the ends of filaments 1' and anchored by adequate means such as fixing with an appropriate adhesive. A fastening means *b* including a pair of porecelain pieces that are rigidly joined to each other and which form an inner canal is provided. The sheath 2 and conductor 1 occupy one end of the canal and the semiconductor *a* occupies the other end with the connection of the conductor 1 and semiconductor *a* occurring within said canal between the ends thereof. The connection of the conductor 1 and semiconductor *a* may be adjusted within the inner canal of the fastening means *b*.

A projecting terminal 4 of semiconductor *a* is preferably tapered and functions as the electrode terminal 4.

Terminal 4 is placed at a predetermined distance from a negative pole metal electrode 5, of an ordinary type, which is connected to a negative pole of the ignition unit (not shown). The terminal 4 and electrode 5 are positioned adjacent a gas outlet spout 6 of the lighter (not shown).

The material of semiconductor *a* may be a ceramic, having high resistivity, of the type obtained by sintering metal oxides such as cobalt, iron, nickel, manganese, lithium, zinc, titanium, zirconium and the like by means of the ceramic technique. The semiconductor *a* may also be formed of a resistive material obtained through the recrystallization of silicon carbide grains, or by the union of silicon carbides or the like by means of a vitreous die.

Such semiconductors used as electrodes have their own resistance that is of many thousand ohms. Satisfactory results have been obtained with resistances of approximately 33,000 ohms. As already mentioned above, the material that composes the semiconductor electrode does not become degraded through oxidation or heat.

The useful range of resistance of the semiconductor that may vary according to the chemical composition of the material that composes same, is between five thousand and one hundred ohms.

Detailed below is a range of a possible composition of the material that, through a process adopted by the ceramic industry, composes the semiconductor electrode:

| | Min. | | Max. |
|---|---|---|---|
| manganese oxide | 60% | - | 80% |
| copper oxide | 13% | - | 20% |
| iron oxide ($Fe_2O_3$) | 2% | - | 4% |
| lithium oxide | 1% | - | 3% |
| Remainder, colbalt oxide. | | | |

Figure 3:
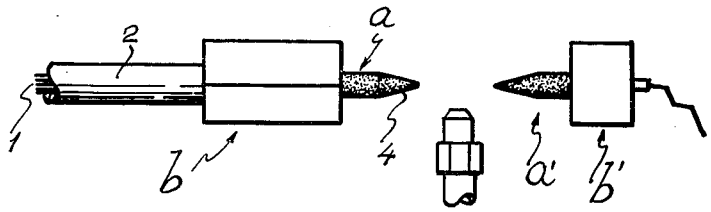
FIG. 3 is a side elevational view of a second preferred embodiment of this invention in which both electrodes are of semiconductor material.

In the second preferred embodiment shown in FIG. 3, the second electrode *a'* connected to the negative pole of the ignition unit (not shown) is also of semiconductor material. The second semiconductor electrode *a'* may also be connected to a conductor with fastening means *b'* similar to the fastening means *b* discussed above.

As another alternative, the semiconductor *a* can be used with the gas outlet spout 6 functioning as a negative electrode. Also the semiconductor *a* could be used with a negative electrode 5 connected to the gas flow.

While in the foregoing there have been described presently preferred embodiments of the present invention, these embodiments are merely illustrative of the invention and other modifications may be made without departing from the true spirit and scope of the invention.

What is claimed is:

1. In a portable piezoelectric type lighter having a pressurized fluid fuel deposit therein, an exit orifice for permitting the release of said fluid, a pair of electrodes, said electrodes connected to a piezoelectric ignition unit for developing an electric potential between said electrodes when said ignition unit is actuated, and a gap separating the pair of electrodes by a predetermined distance, an improved electrode construction comprising:

at least one of said electrodes being elongated and formed of silicon carbide, said silicon carbide electrode having a pair of tapered ends;

a conductor connected to a positive pole of said piezoelectric ignition unit having one of said ends of said silicon carbide electrode connected to said conductor, the other end of said silicon carbide facing said other electrode to form a gap therebetween; and a fastening means of electrically insulating material for covering the connected portions of said conductor and said silicon carbide electrode, said fastening means includes at least two complimentary pieces adapted to fit together and form an inner canal therein for receiving the connecting ends of said conductor and said silicon carbide electrode.

2. The invention as set forth in claim 1 wherein said conductor includes an insulating sheath surrounding conductive filaments, said filaments projecting beyond the end of said sheath and wherein one of said tapered ends of said semiconductor is inserted toward said sheath between said filaments.

* * * * *